US005110046A

United States Patent [19]

Young

[11] Patent Number: 5,110,046

[45] Date of Patent: May 5, 1992

[54] RAIL FASTENING SYSTEM

[75] Inventor: Hartley F. Young, Melton, Australia

[73] Assignee: McKay Australia Limited, Maidstone, Australia

[21] Appl. No.: 489,498

[22] Filed: Mar. 7, 1990

[30] Foreign Application Priority Data

Mar. 9, 1989 [AU] Australia ..... PJ3138

[51] Int. Cl.[5] ..... E01B 9/38

[52] U.S. Cl. ..... 238/283; 238/287

[58] Field of Search ..... 238/272, 274, 283, 287, 238/301, 307, DIG. 1

[56] References Cited

U.S. PATENT DOCUMENTS

| | | | |
|---|---|---|---|
| 31,283 | 1/1861 | Weight | 238/283 |
| 590,108 | 9/1897 | Lewis | 238/283 |
| 961,052 | 10/1909 | Warren | 238/283 X |
| 1,039,748 | 10/1912 | Hyle et al. | 238/283 X |
| 1,406,074 | 2/1922 | Pierson | 238/283 |
| 1,750,735 | 3/1930 | Tupper | 238/DIG. 1 X |
| 1,772,875 | 8/1930 | O'Brien | 238/283 |
| 2,057,955 | 10/1936 | Kahn | 238/283 |
| 2,770,421 | 11/1956 | Wilson | 238/283 |
| 3,581,990 | 10/1968 | Kirik | 238/287 X |
| 4,925,094 | 5/1990 | Buekett | 238/283 X |

OTHER PUBLICATIONS

"Epoxies", Railway Track and Structures, Jul. 1962, pp. 20–23.

*Primary Examiner*—David A. Bucci
*Assistant Examiner*—James Keenan
*Attorney, Agent, or Firm*—Hodgson, Russ, Andrews, Woods & Goodyear

[57] ABSTRACT

A rail seat resistant to abrasion of the concrete rail tie incorporates a thin metal plate between the rail tie and the elastomeric rail pad which insulates the rail from the rail tie. The plate may be bonded to the rail tie or a resilient gasket can be interposed between the rail tie and the plate.

3 Claims, 2 Drawing Sheets

RAIL FASTENING SYSTEM

BACKGROUND OF THE INVENTION

This invention relates to improvements in rail fastening systems where rails are elastically fastened to rail ties. In particular this invention relates to rail fastening systems utilizing concrete rail ties.

Conventionally rails are held to rail ties by rail clips or fasteners which bear down on the rail flange. A rail pad located beneath the rail and composed of elastomeric material such as rubber, polyurethane, ethylvinylacetate or high density polyethylene insulates the rail from the rail tie. This pad has a field side on the outer side of the rail and gauge side on the inner side of each rail.

Concrete rail ties have been found to be prone to wear particularly in sandy locations. This invention is partly predicated on discovering the cause of this wear. As each loaded bogey passes over the tie, the rail pad deflects vertically and thus acts as a shock absorber. However, due to the poissons ratio of the materials used the pad must also deflect horizontally which means that every vertical load pulse causes the pad face to slide horizontally over the concrete tie.

In normal use this causes slight wear to the pad and practically no wear to the concrete face. However, in the presence of sand particles the grains of sand imbed themselves into the relatively soft pad material and slide on the concrete face. The same particles cut the concrete paste in the mortar causing abrasion to the concrete paste and mortar which can shorten the working life of the concrete rail tie.

SUMMARY OF THE INVENTION

It is an object of this invention to overcome this difficulty with rail clamping systems on concrete ties.

To this end the present invention provides an abrasion plate for insertion between the rail pad and the rail tie.

Tie rail seat abrasion can be prevented or at least greatly reduced by the use of an abrasion plate made from very hard material such as heat treated steel.

The plate is used between the bottom face of the rail pad and the top face of the tie rail seat and works in the following manner:

As the load pulse is transmitted through the rail to the rail seat the rail pad deflects vertically and horizontally as normal, but the abrasion plate is made from such hard stiff material that there is no significant horizontal deflection of the plate and therefore no relative motion between the abrasion plate and the concrete rail seat face, so any sand particles at this interface do not cause abrasion since there is no horizontal motion.

The horizontal movement of the rail pad now takes place at the interface on top of the abrasion plate, so any sand particles here will tend to wear the abrasion plate. This plate is preferably made from heat treated high carbon steel to hold the wear rate of the abrasion plate down to a slow rate. Of course, the abrasion plate can be replaced when it is worn out.

The abrasion plate is preferably captive between the two support shoulders in the rail seat and after first being installed it may move slightly to take up any clearance between the abrasion plate and shoulders. However once in this position it should not move significantly due to the clamping force of the rail clips. When the rail pad deflects sideways, it moves in all horizontal directions which tend to cancel out any net horizontal forces to such an extent that they are not high enough to cause the abrasion plate to oscillate relative to the concrete rail seat face.

It is essential to provide an effective seal between the plate and concrete rail tie. Preferably the abrasion plate may be adhered to the surface of the concrete tie to ensure that ingress of abrasive particles and water onto the surface of the rail tie is avoided.

The abrasion plate is preferably made from thin material (about 1 mm thick) so that the plate may be used under the rail pad without any significant change in rail clip vertical deflection. Thus, the abrasion plate may be used in standard rail fastening assemblies only where rail seat abrasion is likely to take place.

BRIEF DESCRIPTION OF THE DRAWING

A preferred embodiment of the invention is shown in FIGS. 1 and 2 wherein FIG. 1 provides a cross-sectional view of a rail seat according to this invention

DESCRIPTION OF THE PREFERRED EMBODIMENTS

Figure 1:
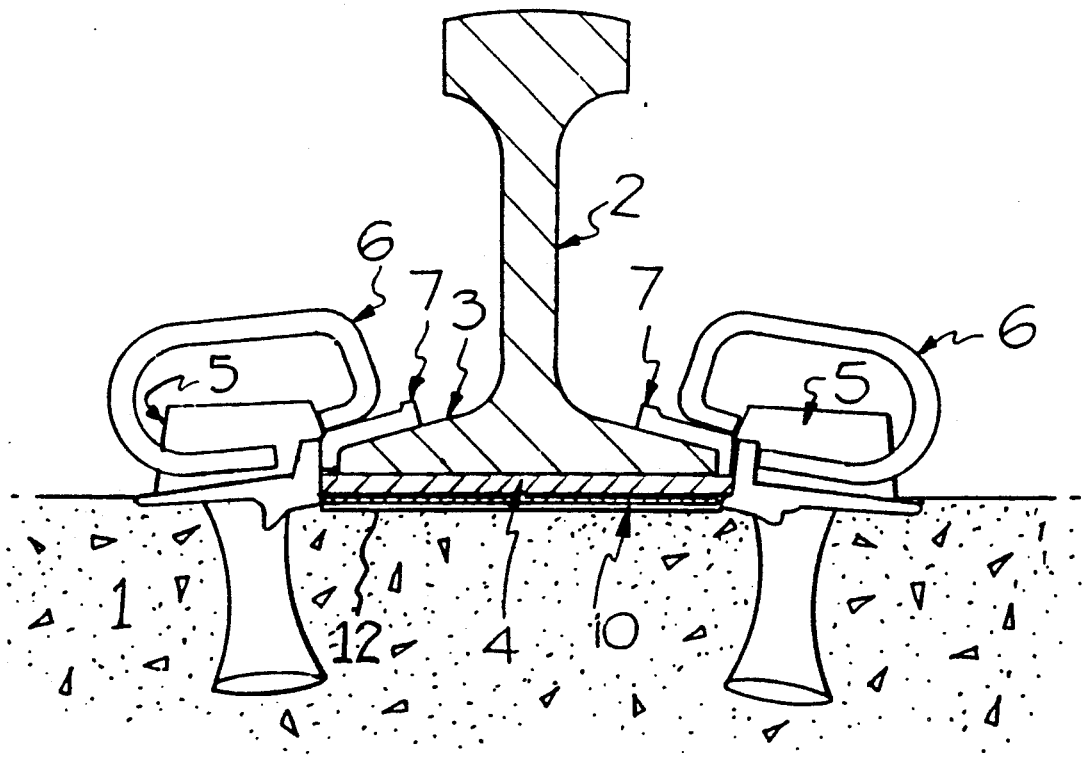
Figure 2:
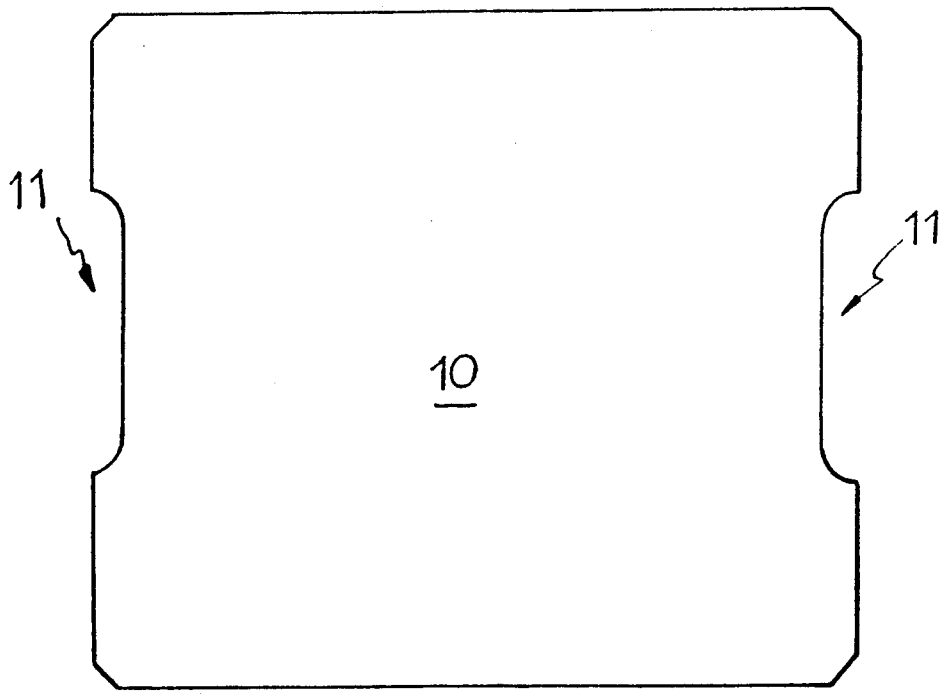
FIG. 2 is a plan view of the abrasion plate.

The concrete rail tie 1 supports a rail 2 which has flanges 3 and sits on a rail pad 4 interposed between rail 2 and the concrete tie 1.

The rail is held in place by rail clamp 6 which is held in clamp support 5 embedded in the concrete tie 1. The toe portion of the clamp 6 bears down on rail flange 3 through the insulator 7.

The improvement of this invention is to provide an abrasion plate 10 between the pad 4 and the tie 1. The plate 10 is smooth edged and incorporates recesses 11 to fit around the clamp supports or shoulder 5.

The plate 10 may be bonded by layer 12 of adhesive (epoxy resin adhesives are preferred) to the tie 1 or an HDPE closed cell foam of 1.5 mm thickness of the same size and shape as plate 10 fitted between plate 10 and tie 1.

From the above it can be seen that this invention provides a unique solution to the problem of wear on concrete rail ties.

The claims defining the invention are as follows:

1. An abrasion resistant rail seat for securing a rail to a concrete rail tie of the type in which the rail has a flange and is secured to a concrete rail tie by elastic rail clamps and an elastomeric rail pad insulates the rail from the rail tie, the improvement comprising interposing an abrasion resistant plate between said rail pad and said rail tie, said abrasion resistant plate forming a water tight seal with said rail tie, said abrasion resistant plate being wider than said rail and extending beyond the flange of said rail, and a layer of adhering material between said abrasion resistant rail plate and said rail tie for adhering said plate to said tie, said material being the sole means for adhering said plate to said tie so that replacement of said abrasion resistant rail plate is facilitated.

2. A rail seat as claimed in claim 1, wherein the plate is of metal approximately one millimeter thick.

3. A rail seat as claimed in claim 2, wherein said adhering material is a closed cell foam pad of one to two millimetres in thickness and of similar shape to said plate.

* * * * *